US005950739A

United States Patent [19]

LaFontaine

[11] Patent Number: 5,950,739

[45] Date of Patent: Sep. 14, 1999

[54] EARTH PIERCING APPARATUS

[76] Inventor: Stephen J. LaFontaine, 6814 Burke Ct., Chino, Calif. 91710

[21] Appl. No.: 08/926,243

[22] Filed: Sep. 5, 1997

[51] Int. Cl.[6] ..... E21B 7/08

[52] U.S. Cl. ..... 175/19

[58] Field of Search ..... 175/19, 20, 21, 175/22

[56] References Cited

U.S. PATENT DOCUMENTS

| | | | |
|---|---|---|---|
| 102,647 | 5/1870 | Ayres et al. | 175/19 |
| 674,191 | 5/1901 | Allen et al. | 175/19 |
| 740,521 | 10/1903 | Brown | 175/19 |
| 903,126 | 11/1908 | Beall, Jr. | 175/19 |
| 2,472,120 | 6/1949 | Murphy | 175/22 |
| 4,974,687 | 12/1990 | Kayes | 175/19 |

*Primary Examiner*—William Neuder
*Attorney, Agent, or Firm*—Robert R. Meads

[57] ABSTRACT

An earth piercing apparatus comprising a metal drive tool having a pointed forward end and an axially extending cavity at a rear end. The cavity includes a forward chamber and a female thread in an inner wall of the cavity adjacent the chamber for receiving a forward end of a driving rod having a male nesting end engaging a laterally extending stop surface in the chamber and a male thread mating with the female thread in the cavity. An end of the rod remote from the drive tool forms a driving end for receiving axial impulses for propelling the apparatus in a forward direction through soil to form a uniform hole in the soil.

5 Claims, 4 Drawing Sheets

EARTH PIERCING APPARATUS

BACKGROUND OF INVENTION

The present invention relates to apparatus for creating laterally extending holes in the ground for receiving pipe, conduit, electrical cable or the like. More particularly, the present invention relates to an improved earth piercing apparatus for forming such laterally extending holes.

In the construction industry, a common problem is the placing of pipe, conduit, electrical cable or the like under existing structures such as curbs, sidewalks, driveways and the like. Commonly, such problems are addressed by digging trenches adjacent to and under such structures and forcing the pipe, conduit, electrical cable etc. through the trenches and under such structures.

Alternatively, apparatus and methods have been developed for drilling or otherwise forming holes under sidewalks, curbs, roadways and the like which include the use of high pressure water in combination with tubular or solid pipes. The use of such alternative apparatus results in mud and debris which interferes with the placement of electrical and water conduit, etc. and of course destroys the cleanliness of the work place.

Still other earth piercing apparatus has been proposed and is described in various patents including U.S. Pat. Nos. 2,327,616; 2,619,832; 2,902,532 and 3,554,303. In addition, such apparatus is described in Canadian patent 693,404 and in publication WO87/04487.

Unfortunately, none of the commercially available apparatus or apparatus described in publications such as the foregoing patents provides a satisfactory simple solution to the problem of forming clean, uniform diameter, laterally extending ground holes under existing structures. The present invention addresses and satisfies such long existing needs.

SUMMARY OF INVENTION

To overcome the foregoing problems, the present invention provides an earth piercing apparatus comprising a metal drive tool having a pointed forward end and an axially extending cavity at a rear end. The cavity includes a forward chamber and a female thread on an inner wall adjacent the chamber. A forwardly extending male end of a driving rod is seated in the cavity with a forward male nesting end of the rod bearing on a laterally extending stop surface in the chamber and with a male thread on the rod mating with the female thread in the cavity. An end of the rod remote from the drive tool forms a driver end for receiving axial impulses for propelling the drive tool and rod in a forward axial direction to pierce the ground under existing structures to form clean perfect diameter holes in the ground for receiving pipe, conduit, electrical cable and the like.

BRIEF DESCRIPTION OF THE DRAWINGS

FIG. 7 is a fragmentary sectional side view of an opposite end of the driving rod including a driver cap coupled to the driving rod for receiving axial impulses, as from a hammer, driving the earth piercing apparatus laterally through soil and under a structure to produce a uniform diameter hole in the soil for the laying of pipe, conduit, electrical cable and the like.

DETAILED DESCRIPTION OF INVENTION

Figure 1:
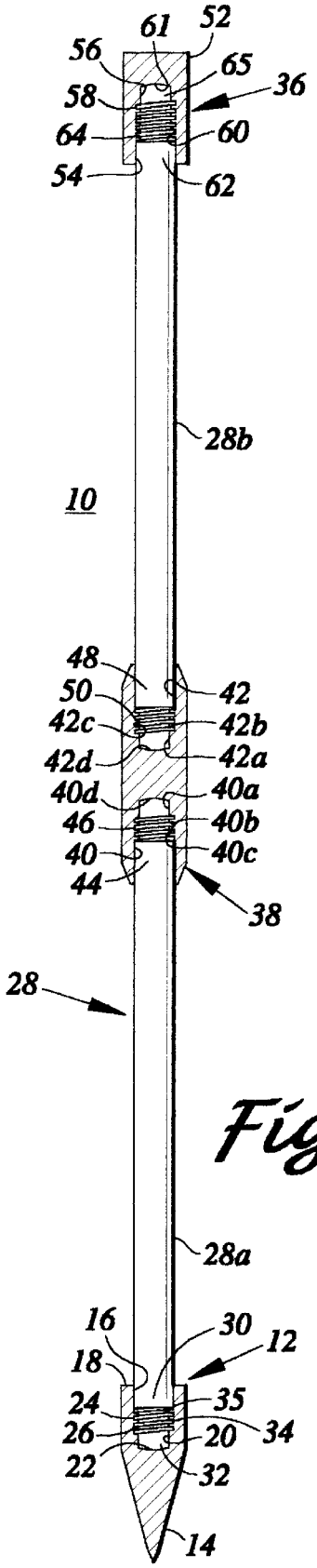
FIG. 1 is a side view, partially in section, of a preferred form of the earth piercing apparatus of the present invention.

Basically, the improved earth piercing apparatus of the present invention is illustrated in FIG. 1 and designated by the number 10. The apparatus 10 comprises a drive tool 12 having a pointed forward end 14 and an axially extending cavity 16 in a rear end 18 of the drive tool. Preferably, the drive tool is formed of a high tempered steel such as S-7 triple heat treated to 55-Rockwell-C-hardness.

Figure 3:
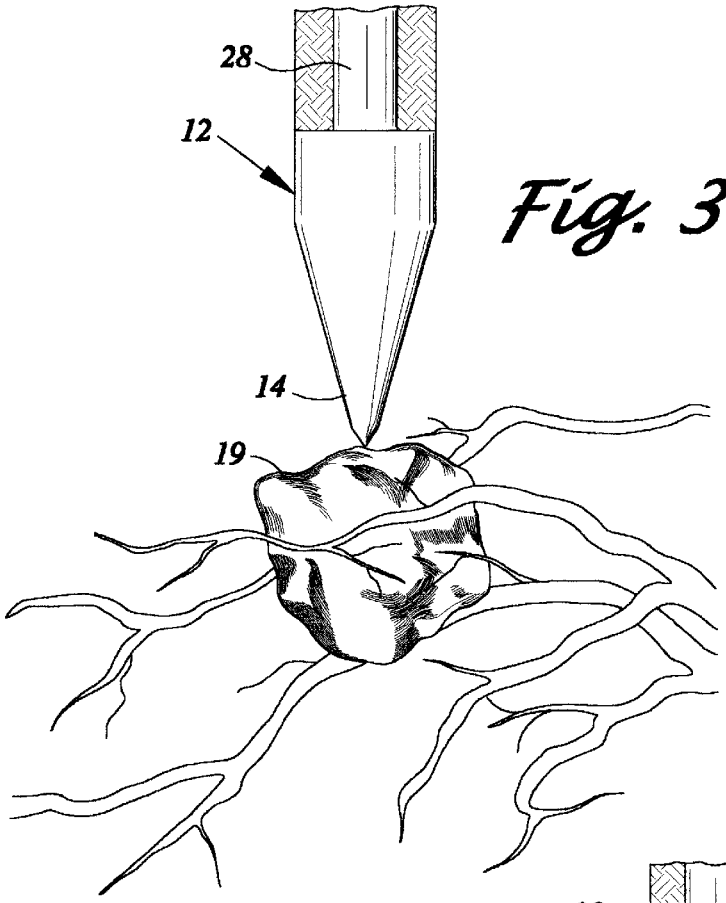
FIG. 3 is a diagrammatic representation of the drive tool of FIG. 2 in use engaging an obstacle with the tip of the tool, the cross-hatched portion depicting the uniform diameter hole formed by the tool as it moves through the soil.
Figure 4:
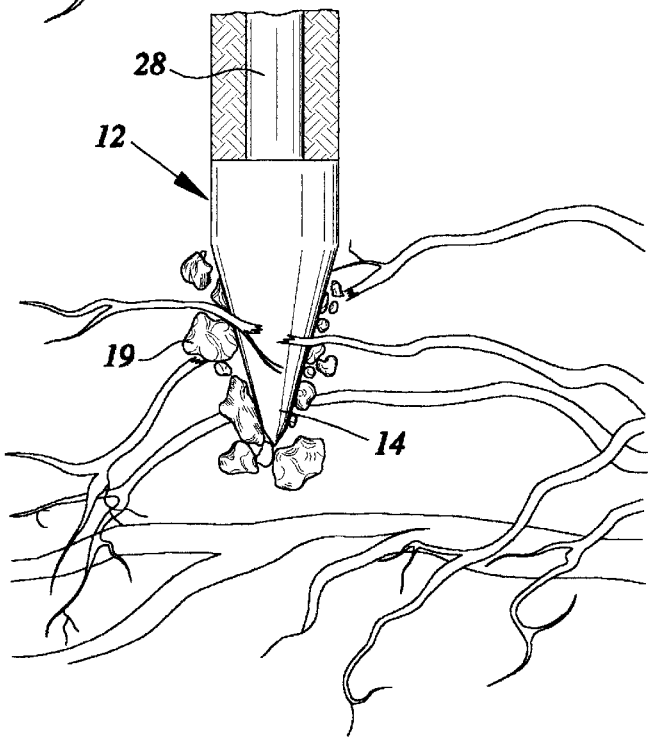
FIG. 4 is a diagrammatic representation similar to FIG. 3 showing the tip of the tool breaking apart the obstacle with fragments of the obstacle being pushed outward into surrounding soil as the drive tool advances into the soil.
Figure 5:
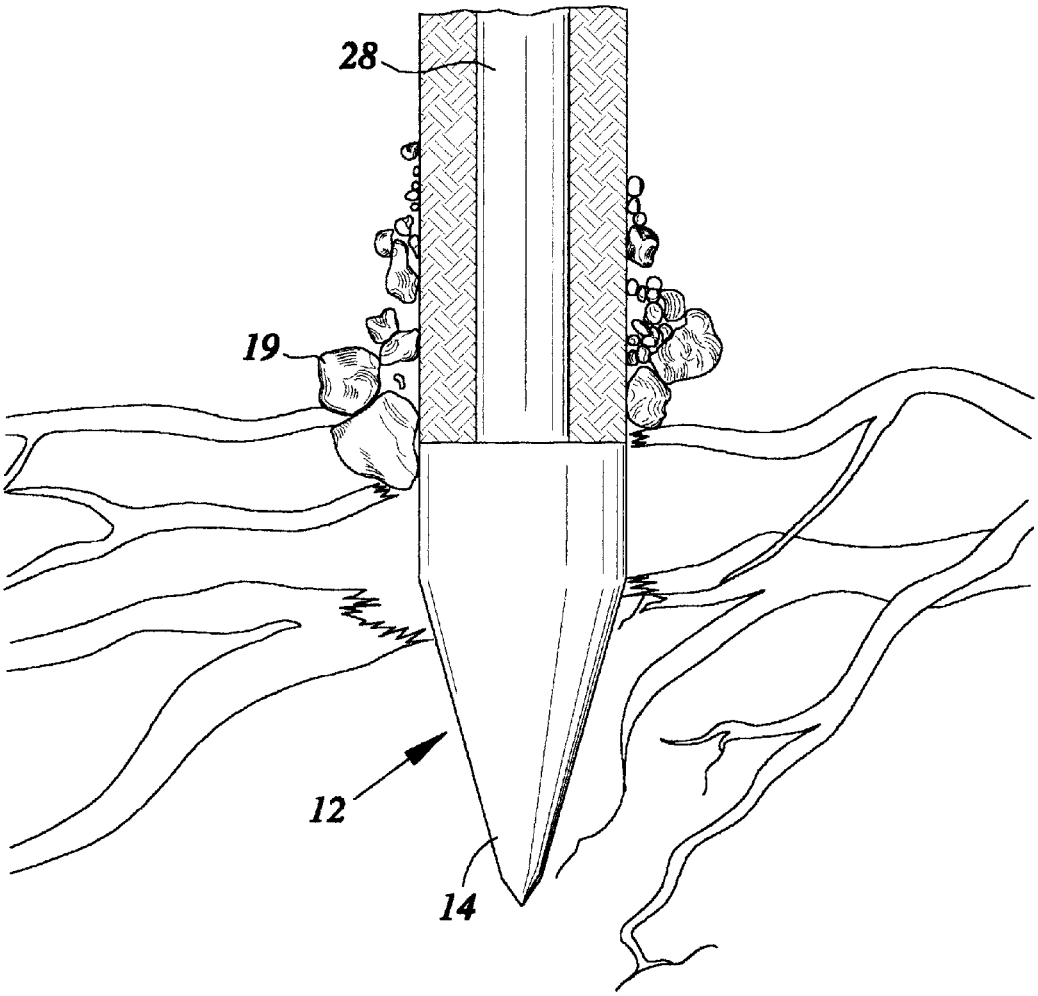
FIG. 5 is a diagrammatic representation similar to FIG. 4 illustrating how the drive tool and associated drive rod in further advancing into the soil leave only a clean perfect diameter hole in the soil.

The pointed forward end 14 of the tool 12 is intended to pierce or break apart obstacles it encounters in being driven axially through soil as it is illustrated in FIGS. 3, 4 and 5 wherein an encountered obstacle 19 is pierced and broken apart, the fragments pushed outward into the surrounding soil leaving only a clean perfect diameter hole in the soil as depicted in FIG. 5.

Figure 2:
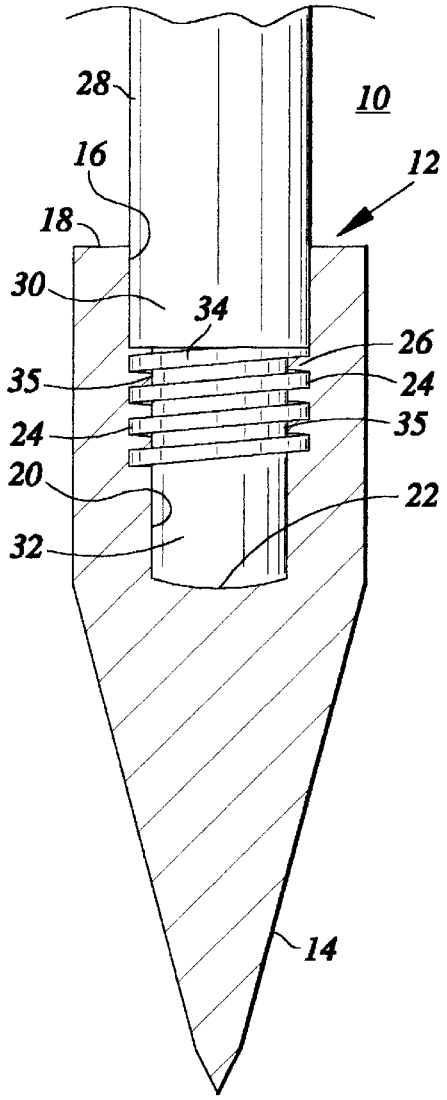
FIG. 2 is a cross sectional side view of the earth piercing drive tool portion of the apparatus shown in FIG. 1, slightly enlarged.
Figure 6:
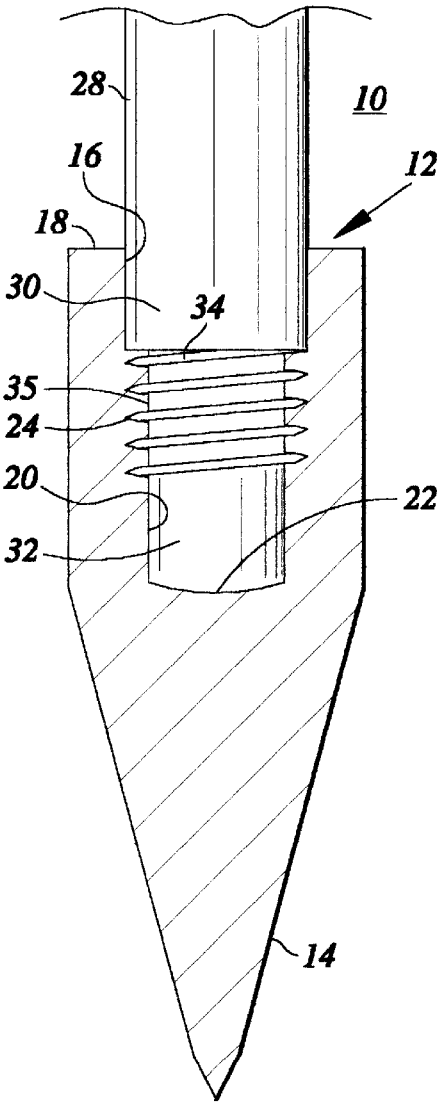
FIG. 6 is a fragmentary sectional side view of the piercing tool and a forward end of a driving rod of the earth piercing apparatus of the present invention illustrating an alternate thread design for the coupling of the earth piercing drive tool to the driving rod.
Figure 7:
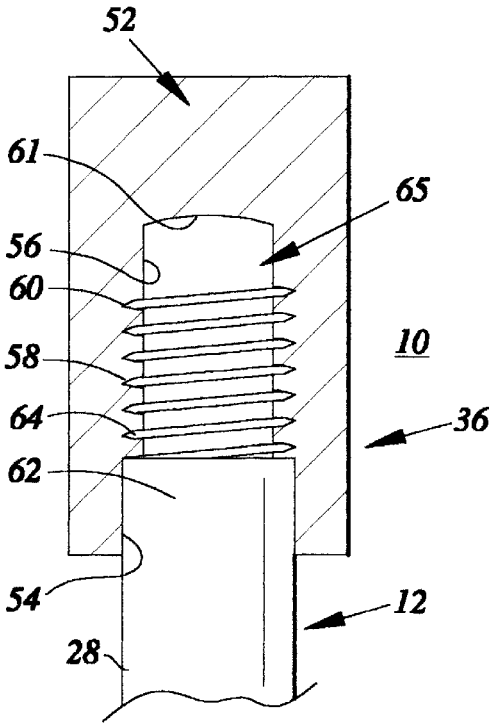

The rear end 18 of the drive tool 12 includes the axial extending cavity 16 having a forward chamber 20 having a laterally extending stop surface 22 here depicted as being the forward end of the chamber 20. Adjacent the chamber 20, a female thread 24 is formed in an inner wall 26 of the chamber. The radially outermost surfaces of the treads 24 may be flat as indicated in FIGS. 1 and 2 or generally pointed as depicted in FIGS. 6 and 7.

Thus constructed, the cavity 16 is designed to axially receive a forward end of a driving rod 28. The driving rod 28 includes a forwardly extending male end portion 30 with a forward male nesting end 32 and a male thread 34 extending from an outer surface 35 of the end portion 30. The forward male nesting end 32 is dimensioned to extend forward beyond the male thread 34 a distance at least equal to the axial length of the chamber 20 such that as the male thread 34 mates with the female thread 24 upon a turning of the driving rod 28 relative to the drive tool 12, the forward male nesting end. 32 engages and presses tightly against the laterally extending stop surface 22. Also, as indicated in FIGS. 1 and 2, the male thread 34 may have a flat outer surface, or as indicated in FIG. 6 and 7, a pointed outer surface engaging a mating female thread such as 24.

An opposite end of the driving rod 28 comprises a driver end 36 for receiving axial impulses to drive the earth piercing apparatus 10 forward and in a laterally extending direction through soil under existing structures to engage, pierce, break and push outward fragments of obstacles leaving only a clean perfect diameter in the soil as depicted in FIGS. 3, 4 and 5. The axial impulses may be generated by a hammer striking the driver end 36 of the rod 28 or may be provided by other mechanical means.

Depending upon the length of the hole which is to be formed in the soil, the driving rod 28 may be formed of one or more sections. For example, in FIG. 1, the driving rod 28 is formed of a plurality of rods 28*a* and 28*b* coaxially connected by a tubular coupler 38 having a opposing cavities 40 and 42 for receiving a rearward end of rod 28*a* and a forward end of rod 28*b* respectively. The cavities 40 and 42 resemble in structure the cavity 16 previously described and the rear end of rod 28*a* and front end of rod 28*b* resemble the structure of the forwardly extending male end portion 30 of the driving rod 28 as previously described. In particular, the cavity 40 includes a rear chamber 40*a* and a female thread 40*b* formed in an inner wall 40*c* of the chamber 40*a*. The chamber 40*a* also includes a laterally extending stop surface 40*d* here formed by the rear end surface of the chamber 40*a*.

Thus constructed, the cavity 40 is designed to receive a rearwardly extending male end portion 44 of the rod 28*a* with a male thread 46 extending from an outer surface of the rod and mating with the female thread 40*b*. In this regard, the rearmost end of the rearwardly extending male end portion 44 of the rod is dimensioned to engage and bear against the stop surface 40*d* of the chamber 40*a* as the coupler 38 is turned relative to the rod 28*a*.

Similarly, a cavity 42 in the coupler 38 includes a forwardly extending chamber 42*a* and a female thread 42*b* formed in an inner wall 42*c* of the chamber. The chamber 42*a* also includes a laterally extending stop surface 42d here comprising the forward end of the chamber 42*a*. Thus constructed, the cavity 42 is designed to receive a forwardly male end portion 48 of the rod 28*b* having a male thread 50 mating with the female thread 42*b* as the rod 28*b* is turned relative to the coupler 38. The forward most end of the forward extending male end portion 48 is dimensioned such that as the male thread 50 mates with the female thread 42*b*, the forward end portion engages the stop surface 42*d* and bears tightly there against.

Finally, independent of the number of rod sections forming the driving rod 28, the driver end 36 of the driving rod comprises a drive cap 52 as depicted most clearly in FIG. 7. The drive cap 52 includes an axially extending cavity 54 including a rearward chamber 56 and a female thread 58 formed in an inner wall 60 of the cavity 54. Further, the chamber 56 includes a laterally extending stop surface 61 here defined as being the rearward most inner surface of the chamber.

Thus constructed, the drive cap 52 is designed to receive a rear end of the driving rod 28 with a rearwardly extending male end portion 62 of the rod extending into the cavity 54 with a male thread 64 engaging the female thread 58 and a rearmost end 65 of the male end portion 62 bearing against the stop surface 61.

Thus constructed, the improved earth piercing apparatus 10 of the present invention comprises a simple but sturdy structure for transferring axial impulses applied to a rear end of the drive cap 52, as by a sledge hammer, axially forward to the tip end of the drive tool 12 without exerting axial shearing forces on the threads comprising the mating couplings between the drive tool 12 and driving rod 28, between driving rods 28*a* and 28*b* and the coupler 38, and between the drive rod 28 the drive cap 52. In this regard, the driving rod includes forwardly and rearwardly extending end portions beyond the male threads which bear against the stop surfaces in the cavities of the drive tool, drive coupler and end cap. Such engagement insures that the axial impulses are transferred to the rod and drive tool without relative axial motion between the drive cap and rod and between the drive rod sections and coupler and between the drive rod and the drive tool to develop undesired shearing forces on the threads. Such transfer of forces is direct around the threads and results in a piercing action at the forward end of the drive tool as it passes through the soil to produce a uniform diameter hole as depicted in FIGS. 3, 4 and 5.

While a particularly preferred embodiment of the present invention has been described in detail, changes and modifications may be made therein without departed from the spirit of the invention. Accordingly, the present invention is to be limited in scope only by the terms of the following claims.

I claim:

1. An earth piercing apparatus comprising:

a metal drive tool having a pointed forward end and an axially extending cavity at a rear end;

a forward chamber in the cavity including a laterally extending stop surface;

a female thread on an inner wall of the cavity adjacent the chamber;

a driving rod having a forwardly extending male end seated in the cavity with a forward male nesting end of the rod bearing on the laterally extending stop surface of the chamber and with a male thread on the rod mating with the female thread in the cavity; and a drive end of the rod remote from the drive tool for receiving axial impulses for propelling the apparatus in an axial direction.

2. The apparatus of claim 1 wherein the driving end of the rod comprises a drive cap containing an axially extending cavity defining a rearmost chamber and a female thread in an inner wall of the cavity, the chamber having a laterally extending stop surface; and the driving rod including a rearwardly extending male end portion seated in the cavity in the drive cap with a male nesting end of the rod bearing on the laterally extending stop surface in the chamber of the drive cap and with a male thread on the rod mating with the female thread in the cavity of the drive cap.

3. The apparatus of claim 1 wherein the driving rod comprises a plurality of coaxial rods axially connected by a tubular coupler having opposing cavities for receiving a rear end of a forward one of the rods and a front end of a rearward one of the rods respectively.

4. The apparatus of claim 3 wherein the opposing cavities in the tubular coupler each comprise a chamber having a laterally extending stop surface and a female thread in an inner wall of the cavity; and the forwardmost rod includes a rear end having a male end portion engaging the lateral stop surface of the forwardmost cavity in the coupler and a male thread engaging the female thread of the forwardmost cavity of the coupler; and the rearwardmost rod includes a forwardly extending male end portion in the rearwardmost cavity of the coupler engaging the lateral stop surface of the chamber in the rearwardmost cavity of the coupler and a male thread for engaging the female thread in the rearwardmost cavity of the coupler.

5. The apparatus of claim 4 wherein the rearwardmost driving rod includes a drive end comprising;

a drive cap containing an axially extending cavity defining a chamber and a female thread in an inner wall of the cavity and the chamber having a laterally extending stop surface, and a rearwardmost end of the rearwardmost driving rod including a male end portion engaging the laterally extending stop surface in the chamber of the cavity in the drive cap, and a male thread mating with the female thread in the cavity of the drive cap.

* * * * *